United States Patent [19]

Brady et al.

[11] Patent Number: 4,493,617

[45] Date of Patent: Jan. 15, 1985

[54] FUEL INJECTION PUMP WITH PLUNGER STROKE CONTROL

[75] Inventors: C. Eugene Brady, Avon, Conn.; Marcus J. Gottsche, Hampden, Mass.; Paul W. Stoll, West Suffield, Conn.

[73] Assignee: Stanadyne, Inc., Windsor, Conn.

[21] Appl. No.: 472,074

[22] Filed: Mar. 4, 1983

[51] Int. Cl.[3] ..... F04B 49/00

[52] U.S. Cl. ..... 417/214; 123/504; 417/221; 417/462

[58] Field of Search ..... 417/221, 214, 462, 461, 417/460; 92/13; 123/450, 501-504

[56] References Cited

U.S. PATENT DOCUMENTS 3,046,905 7/1962 Davis ..... 417/462 X 4,292,012 9/1981 Brotherston ..... 417/462

4,393,826 7/1983 Tumber ..... 417/462 X 4,397,615 8/1983 Mowbray ..... 417/221

*Primary Examiner*—Edward K. Look

*Attorney, Agent, or Firm*—Prutzman, Kalb, Chilton & Alix

[57] ABSTRACT

A rotary fuel injection pump having a rotary charge pump and a stroke control mechanism for variably limiting the outward stroke of a pair of diametrically opposed reciprocable pumping plungers of the charge pump for controlling the fuel charge measure delivered by the charge pump. Several embodiments of a stroke control mechanism are disclosed which include a generally U-shaped abutment yoke mounted within a diametral slot in the pump rotor for engagement by inclined ramps on the outer ends of the charge pump plungers and axially adjustable within the rotor slot for variably limiting the outward stroke of the plungers.

20 Claims, 16 Drawing Figures

FUEL INJECTION PUMP WITH PLUNGER STROKE CONTROL

BACKGROUND AND SUMMARY OF THE INVENTION

The present invention relates generally to fuel injection pumps of the type having a rotary charge pump with one or more reciprocating pumping plungers for supplying sequential measured charges of fuel under high pressure to an associated internal combustion engine and relates more particularly to an improved control device for controlling the stroke of the pumping plungers.

In a fuel injection pump of the type having a rotary charge pump with reciprocating pumping plungers, it may be desirable to control the fuel charge measure supplied by the pump by limiting the outward or intake stroke of the plungers. U.S. Pat. No. 4,225,291 of G. W. Bouwkamp et al entitled "Fuel Injection Pump and Plunger Control Means Therefor" discloses such a device for limiting the stroke of the plungers.

In accordance with the present invention, several embodiments of a stroke control mechanism are provided which employ a new and improved plunger stroke limit device for variably limiting the outward stroke of the plungers. The stroke limit device is compact and useful with conventional rotary distributor type fuel injection pumps without substantial pump modification, has notable utility with conventional rotary charge pumps of the type having one or more pairs of diametrically opposed pumping plungers and is operative to limit the outward stroke of the charge pump plungers with a high degree of repeatability and parts reliability over a long service free life.

Further, in accordance with the present invention, the stroke limit device is useful in limiting the charge pump plunger stroke to a preestablished fixed limit or to each of two different predetermined stroke limits related to certain engine operating conditions or to an infinitely variable limit etablished in accordance with certain preselected engine operating conditions. Such engine operating conditions include throttle lever position, engine speed, engine altitude or inlet manifold pressure in turbocharged engine applications and engine starting.

A principal object of the present invention is to provide in a fuel injection pump of the type having a rotary charge pump with one or more pairs of diametrically opposed pumping plungers, a new and improved stroke limit device for limiting the outward stroke or displacement of the pumping plungers. In accordance with the present invention, the stroke limit device is compact, is useful with existing rotary distributor type fuel injection pumps without substantial pump modification, can be economically manufactured and provides accurate plunger stroke limit control for repeatable delivery of high pressure fuel charges of the same quantity or measure.

Another object of the present invention is to provide a new and improved stroke control mechanism which will adjust the stroke limit of the plungers in accordance with the throttle lever position. Included in this object is the provision of a pumping plunger stroke control mechanism which automatically compensates for changes in engine altitude or boost pressure in tubocharged engine applications and/or changes in engine speed.

Still another object of the present invention is to provide in a rotary distributor type fuel injection pump, a new and improved pumping plunger stroke control mechanism which provides additional fuel for starting.

A further object of the present invention is to provide a new and improved stroke control mechanism of the type described which is manually adjustable and which can be accurately and precisely set in a simple manner.

Another object of the present invention is to provide a new and improved stroke control mechanism of the type described which is automatically operable to shift the stroke limit of the pumping plungers between first and second preestablished limit settings.

Another object of the present invention is to provide in a rotary distributor type fuel injection pump, a new and improved stroke limit device of the type described which can be controlled in various ways to limit the size of the high pressure fuel charge delivered by the pump, for example by mechanical, electrical hydraulic and/or vacuum operated means of the fuel injection pump or the associated engine.

Other objects will be in part obvious and in part pointed out more in detail hereinafter.

DESCRIPTION OF THE PREFERRED EMBODIMENTS

Figure 12:
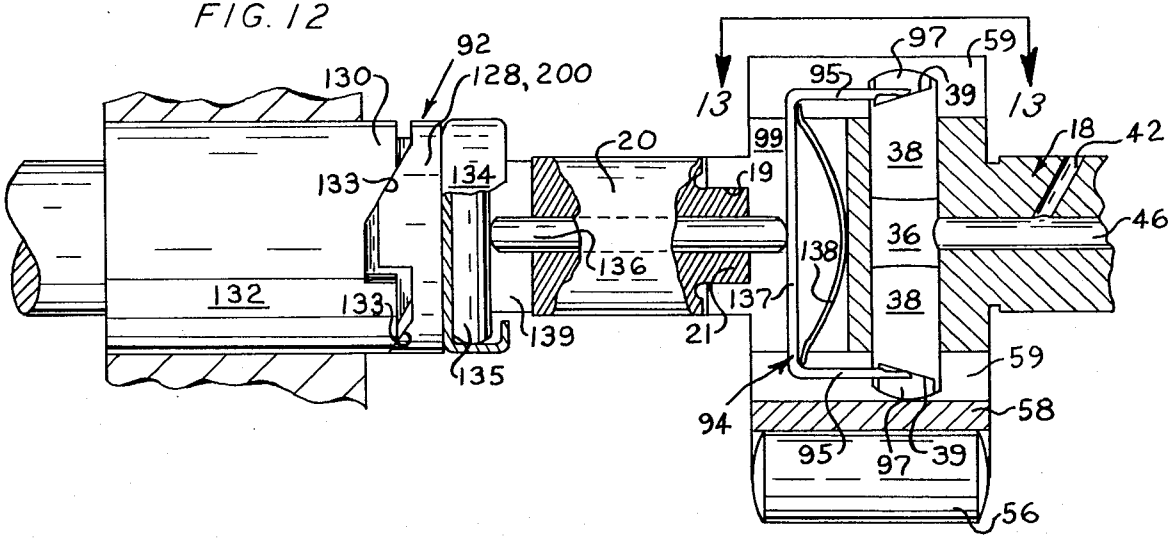
FIG. 12 is an enlarged, somewhat diagrammatic, longitudinal section view, partly broken away and partly in section, showing a plunger stroke limit device employed in the plunger stroke control mechanism embodiments of FIGS. 1–11.
Figure 14:
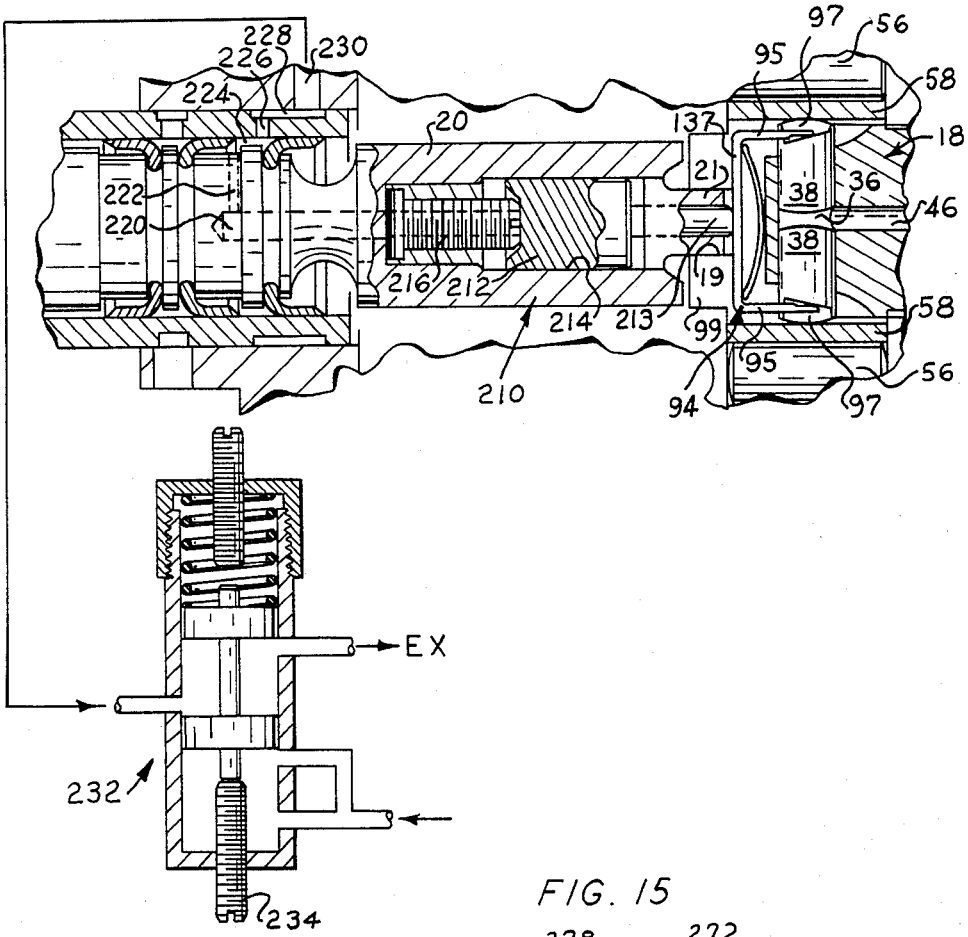
FIG. 14 is partly a diagrammatic illustration and partly an enlarged partial longitudinal section view, partly broken away and partly in section, showing a further embodiment of a plunger stroke control mechanism of the present invention.

Referring now to the drawings in detail wherein like numerals are used to designate the same or like parts throughout, a fuel injection pump incorporating the present invention is of the type adapted to supply sequential measured pulses or charges of fuel under high pressure to the fuel injection nozzles (not shown) of an internal combustion engine (not shown). The pump has a housing 12 and a fuel distributing rotor 18 with a coaxial drive shaft 20 journaled in the housing. The drive shaft 20 is adapted to be driven by the engine (not shown), and (as best shown in FIGS. 12 & 14) is coupled or keyed to the rotor 18 by means of a diametral slot 19 in the outer end of the rotor 18 and an integral, axially extending tang or key 21 at the inner end of the shaft 20.

A vane-type low pressure fuel transfer pump 22 (FIG. 1) is provided at the outer end of the rotor 18 and is driven by the rotor 18. The transfer pump has an inlet 24 for receiving fuel from a suitable fuel reservoir (not shown) and is connected to deliver fuel under transfer pump pressure via axial passage 28, annulus 31 and axial passage 30 to an inlet metering valve 32. A conventional pressure regulating valve 34 (partly shown) is provided to regulate the output or transfer pressure of the transfer pump 22 and return excess fuel to the pump inlet 24. The pressure regulator 34 provides a transfer pressure which increases with engine speed in order to meet the increased fuel requirements of the engine at higher speeds and to provide a speed correlated fuel pressure usable for operating certain pressure actuated mechanisms of the fuel pump.

A high pressure rotary charge pump of the fuel injection pump comprises a pair of diametrically opposed coaxial plungers 38 mounted for reciprocation in a diametral bore 36 of the rotor 18. The charge pump receives metered fuel from the metering valve 32 through a plurality of angularly spaced radial ports 40 (only two of which are shown in FIG. 1) located for sequential registration with a diagonal inlet passage 42 of the rotor 18 as the rotor rotates.

Figure 1:
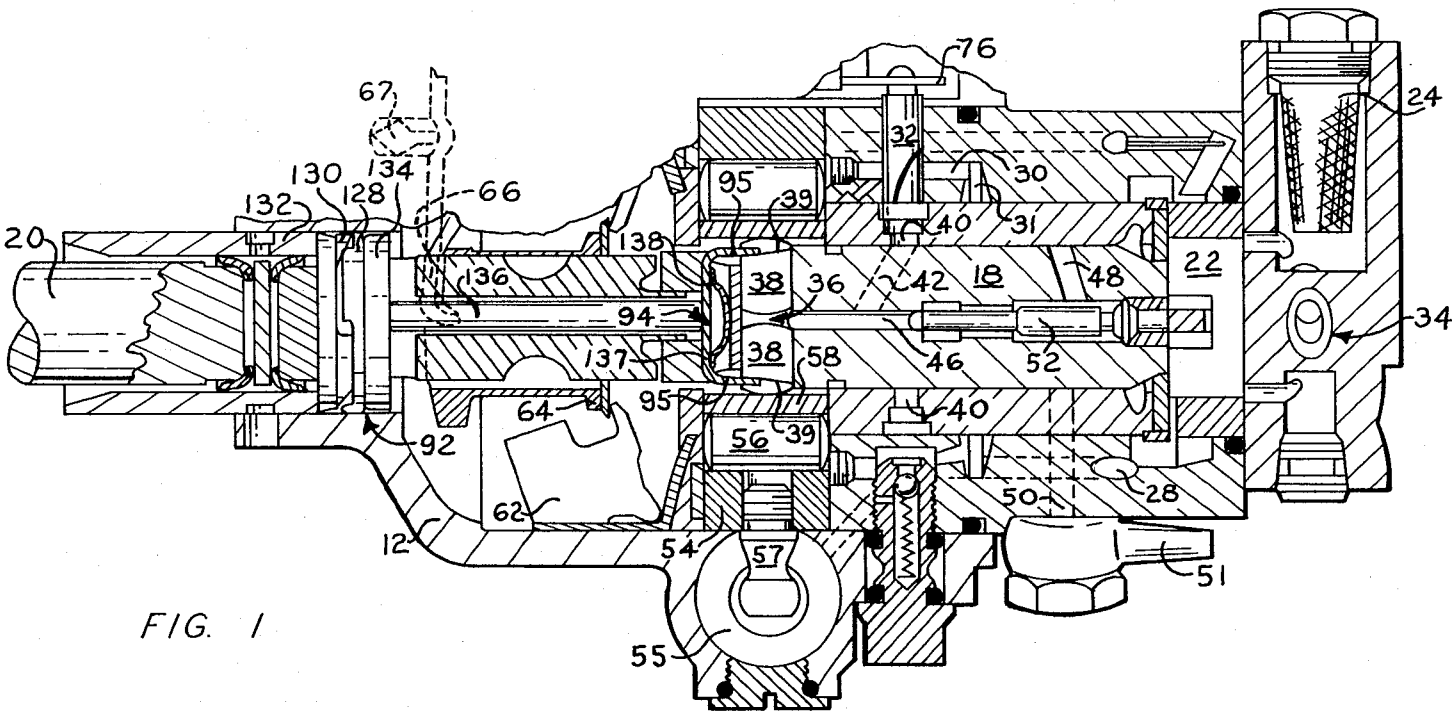
FIG. 1 is a side elevation section view, partly in section and partly broken away, of a fuel injection pump incorporating a first embodiment of a plunger stroke control mechanism of the present invention.

Fuel under high pressure from the charge pump is delivered through an axial bore 46 in the rotor 18 to a distributor passage 48 which registers sequentially with a plurality of angularly spaced outlet passages 50 (only one of which is shown in FIG. 1) which in turn deliver the fuel charges to individual fuel injection nozzles (not shown) of the engine (not shown) via discharge fittings 51 spaced around the periphery of the housing 12. A delivery valve 52 mounted in the axial bore 46 operates to achieve sharp cut-off of fuel to the fuel injection nozzles and to maintain a residual pressure in the downstream fuel delivery passages leading to the nozzles.

The fuel inlet ports 40 are angularly spaced around the rotor 18 to provide sequential registration with the diagonal inlet passage 42 during the outward or intake stroke of the plungers 38, and the outlet passages 50 are similarly spaced to provide sequential registration with the distributor passage 48 during the inward compression or delivery stroke of the plungers 38.

An annular cam ring 54 having a plurality of pairs of diametrically opposed cam lobes is provided for simultaneously actuating the charge pump plungers 38 inwardly for delivering high pressure charges of fuel. A roller 56 and roller shoe 58 are mounted in radial alignmnent with each plunger 38 for actuating the plunger inwardly. Axially extending radial slots 59 (FIG. 12) are provided in the rotor 18 at the outer ends of the diametral plunger bore 36 for receiving the roller shoes 58. For adjusting the timing of delivery of the individual fuel charges to the fuel injection nozzles in correlation with engine operation, the annular cam ring 54 is angularly adjusted by a timing piston 55 connected to the cam ring 54 by a connector 57.

A plurality of governor weights 62 (only one of which is shown in FIG. 1) are angularly spaced about the drive shaft 20 and are mounted in a suitable cage attached to the drive shaft 20 to provide a variable axial bias on an axially shiftable sleeve 64 mounted coaxially on the drive shaft 20. The sleeve 64 engages a pivotal governor plate 66 (partly shown in broken lines in FIG. 1) to urge the governor plate 66 clockwise as viewed in FIG. 1 about a support pivot 67 (also shown in broken lines in FIG. 1). The governor plate 66 is urged in the opposite pivotal direction by a governor spring assembly of a governor mechanism (not shown but for example identical to that disclosed in U.S. Pat. No. 4,142,499 of D. E. Salzgeber entitled "Temperature Compensated Fuel Injection Pump"). The opposing bias on the governor plate 66 provided by the governor spring assembly is established by the angular position of a throttle control shaft 96 (FIG. 2) and in a conventional manner provides for idle or minimum speed governing and maximum speed governing. Thus, the governor plate 66 controls the inlet metering valve 32 to provide both minimum and maximum (hereinafter "min/max") speed governing. For that purpose the governor plate 66 is connected to the metering valve 32 in a conventional manner, for example as disclosed in the aforementioned U.S. Pat. No. 4,142,499, by a control arm 76 fixed to the metering valve and a drive linkage (not shown) connecting the governor plate 66 to the control arm 76.

As is well known, the quantity or measure of the charge of fuel delivered by the charge pump in a single pumping stroke of the pumping plungers 38 can be controlled by varying the restriction offered by the metering valve 32 to the passage of fuel to the charge pump. Thus, the angular position of the metering valve 32 provides a fuel charge control, and the opposing forces of the governor spring assembly and governor fly weights 62 control the metering valve 32 to govern the engine speed. Using a governor mechanism and an inlet valve operating linkage as disclosed in the aforementioned U.S. Pat. No. 4,142,499, the governor provides only min/max governing and maximum speed governing and the throttle control shaft 96 directly controls the inlet metering valve 32 throughout the full intermediate speed and load ranges of the engine.

The present invention can also be used with a governor spring assembly and inlet valve operating linkage of the type used for full speed range governing and wherein the control shaft 96 is used to set the engine speed and the governor mechanism governs the fuel injection pump to maintain the engine speed at that speed setting. For example, a full speed range governing mechanism may be used like that disclosed in U.S. Pat. No. 2,865,347 of V. D. Roosa, dated Dec. 23, 1958 and entitled "Control Means For A Fuel Pump Valve".

In addition to fuel metering provided by the inlet metering valve 32, the maximum output of the charge pump during a single pumping stroke is controlled by a stroke control mechanism which limits the outward travel or stroke of the pumping plungers 38. Several embodiments of a stroke control mechanism of the present invention are herewith described. Each of the described stroke control mechanisms employs all or part of a stroke limit device which in general comprises a linear push rod 90 and a rotary to axial motion translation coupling 92 mounted in the pump housing and a thrust collar 134, cross pin 135, linear push rod 136, U-shaped yoke 94 and a leaf spring 138 mounted on the drive shaft 20 and rotor 18. Axial displacement of the push rod 90 causes a corresponding axial displacement of the yoke 94 and thereby changes the maximum stroke limit of the charge pump plungers 38. The yoke 94 is directly engageable by the plunger 38 to limit or stop the outward travel of the plungers. The yoke 94 has a pair of diametrically opposed bifurcated abutment arms 95 engageable by bevelled or inclined ramps 39 at the outer ends of the plungers 38. The ramps 39 are provided on the sides of the outer end of each plunger 38 and each yoke abutment arm 95 has a central axial slot which loosely receives a center section 97 of the plunger 38 which engages the respective roller shoe 58. The outward plunger stroke is limited according to the axial point of engagement of the abutment arms 95 by the inclined ramps 39 and therefore the axial position of the yoke 94. The yoke 94 is mounted within a diametral slot 99 in the rotor 18 which is parallel and adjacent to the diametral plunger bore 36 and between the diametrically opposed roller shoes 58.

The rotor slot 19 which is provided for coupling the drive shaft 20 to the rotor 18 is shown extending normal to the yoke mounting slot 99. In the alternative, the rotor coupling slot 19 could be extended inwardly and angularly relocated to provide a diametral slot for mounting the yoke 94. In addition, where for example the charge pump has two pairs of diametrically opposed plungers 38, a first yoke 94 for one pair of plungers can be mounted in an inward extension of the rotor coupling slot 19 and a second yoke 94 for the other pair of plungers 38 can be mounted in a separate diametral slot 99, in each case with the yoke mounting slot extending parallel and adjacent to the diametral axis of the respective pair of plungers 38. In the alternative, a suitable one piece yoke (not shown) with four angularly spaced abutment arms 95 could be provided for controlling the two pairs of plungers 38, in which event the one piece yoke preferably comprises a single diametral rib 137 (hereinafter described) received in the diametral slot 19 or 99 and an outer integral mounting rim for the four abutment arms 95 which loosely encircles the shaft 20 and/or rotor 18.

The yoke 94 is mounted within its mounting slot 99 for axial movement relative to the rotor and for rotation with the rotor. The center rectangular rib 137 of the yoke 94 is freely but closely received within the diametral slot 99 to maintain the outer bifurcated abutment arms 95 in proper alignment with the pumping plungers 38. The yoke 94 is free to shift or float radially within the diametral slot 99 to accommodate any uneven outward movement of the pair of opposed plungers 38. Also, during inward actuation of the plungers 38 by the cam ring 54, the yoke 94 will automatically shift radially to accommodate any initial uneven inward and outward movement of the plungers 38 until both plungers are actuated inwardly together by the cam ring 54. The self-centering action or radial freedom of movement of the yoke 94 thereby prevents an outward force on the yoke from uneven inward actuation of the plungers 38. Where two yokes 94 are employed as previously described, the two floating yokes 94 are suitably dimensioned to provide the same plunger stroke limit for the two pairs of plungers. Where as previously described, a one piece yoke is provided for two pairs of plungers 38, the rotor mounting slot for the diametral rib 137 of the one piece yoke is suitably dimensioned to permit the yoke to float radially parallel to the axis of each pair of plungers 38.

Since the yoke 94 is engaged directly by the plungers 38, the outward force on the yoke abutment arms 95 is determined by the centrifugal force of the plungers 38 and the unbalance hydraulic force from the different fuel pressures on the opposite ends of the plungers 38. The fuel pressure within the pump housing and therefore on the outer end of each plunger 38 preferably remains substantially constant. The intake fuel pressure at the inner ends of the plungers 38 during their outward or intake stroke is a function of pump speed and the inlet fuel restriction established by the inlet metering valve 32.

A first embodiment of a stroke control mechanism of the present invention is generally designated by the numeral 84 and is shown in detail in FIGS. 1–4, 12 and 13. The stroke control mechanism 84 sets the maximum available stroke of the plungers 38 throughout the full range of operation of the fuel injection pump. When the fuel injection pump employs a governor mechanism providing only min/max governing (of the type disclosed in U.S. Pat. No. 4,142,499), the stroke control mechanism 84 takes over from the metering valve 32 to control or limit the output of the pump from a predetermined intermediate position of the control shaft 96 (preferably at its idle position or a position advanced a few degrees from its idle position) to a wide open position of the control shaft 96. In addition, the stroke control mechanism 84 automatically compensates for changes in altitude and permits a longer pumping stroke during engine cranking to provide excess fuel for starting. The stroke control mechanism 84 can also be used with a full speed range governor (of the type disclosed in U.S. Pat. No. 2,865,347) to provide a maximum torque or load limit throughout the full speed range of the associated engine. When so used, the stroke control mechanism 84 only limits the maximum high pressure fuel charge measure delivered by the charge pump and the full speed range governor controls the fuel charge quantity within that upper limit.

Figure 3:
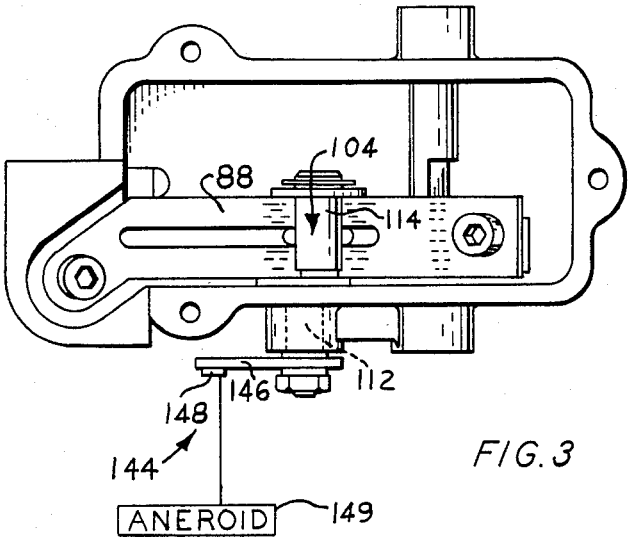
FIG. 3 is partly a diagrammatic illustration and partly a top plan section view of the fuel pump.
Figure 2:
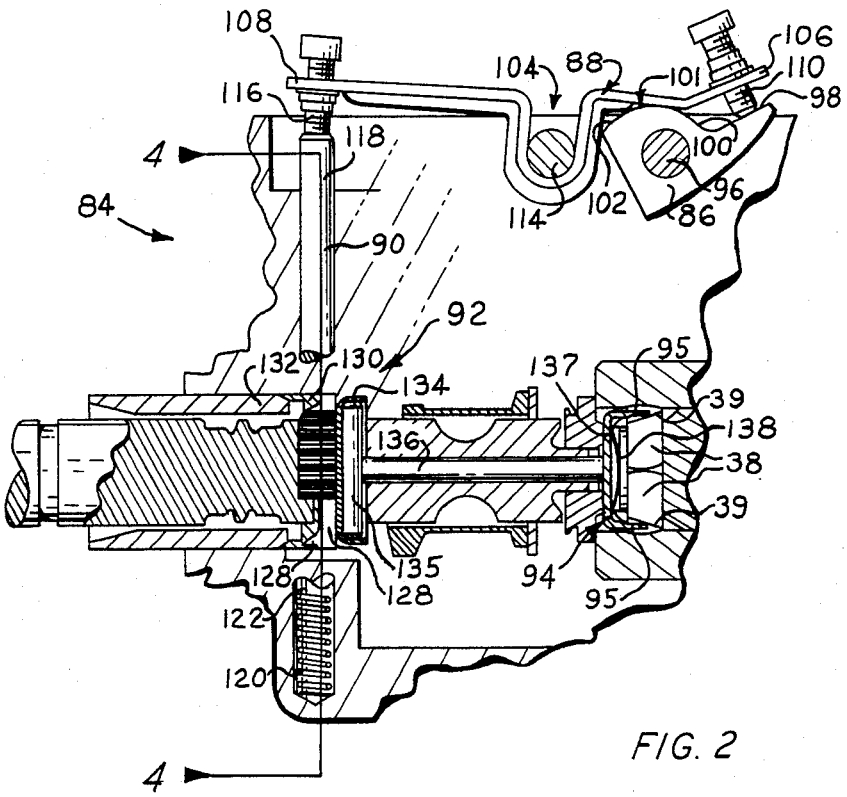
FIG. 2 is an enlarged partial side elevation section view, partly broken away and partly in section, of the fuel pump.

In the embodiment shown in FIGS. 2 and 3, the yoke 94 is connected for being axially shifted by an input control cam 86 which is mounted on the control shaft 96. When the stroke control mechanism 84 is used with a min/max governor, the input control cam 86 is contoured as shown in FIG. 2 to have a first step or arm 98 for establishing an excess fuel position of the yoke 94 for starting and a peripheral cam 101 for axially shifting the yoke during throttle shaft advancement from its idle position. When the stroke control mechanism 84 is used with a full speed range governor, the control cam 86 is modified preferably to have a cylindrical surface in place of the cam surface 101 so that the yoke position is not adjusted by forward rotation of the control shaft 96 from its idle position shown in FIG. 2. Otherwise, the stroke control mechanism 84 is the same with both types of governors.

The fuel control lever 88 is pivotally mounted on a pivot shaft 104 and has a cam follower arm 106 at one end engageable with the cam 101 and an adjustment screw 116 at the other end 108 in engagement with the push rod 90. The fuel control lever 88 has a second adjustment screw 110 for engagement with the step or arm 98 of the cam 86 for starting. The adjustment screw 110 is manually adjustable for setting the angle of the throttle control shaft 96 at which the screw 110 engages the step 98.

The lever pivot shaft 104 is formed with an eccentric or offset shaft section 114 which pivotally supports the fuel control lever 88. A remaining shaft section 112 of the pivot shaft 104 is rotatably mounted on the housing so that angular adjustment of the pivot shaft 104 shifts the axis of the lever pivot shaft generally vertically and generally parallel to the axis of the push rod 90. Thus, limited angular adjustment of the pivot shaft 104 effects a corresponding adjustment of the push rod 90. A suitable actuator such as an aneroid 149 is connected to a crank arm 146 mounted on the outer end of the pivot shaft 104 to angularly position the pivot shaft and thereby vary the position of the fuel control lever axis to compensate for changes in engine altitude or inlet manifold pressure in turbocharged engine applications.

Figure 4:
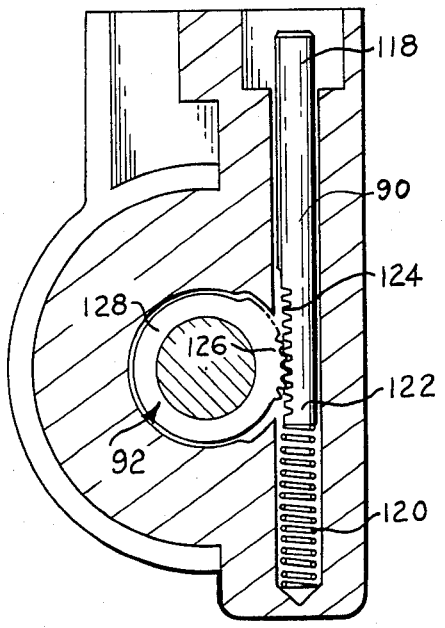
FIG. 4 is an enlarged partial transverse section view, partly in section, of the fuel pump, taken generally along line 4—4 of FIG. 2.

The adjustment screw 116 engages the upper end 118 of the push rod 90 and is manually adjustable to preset the axial position of the yoke 94 relative to the fuel control lever 88. Referring to FIGS. 4 and 12, the linear push rod 90 is slidably mounted within the housing and is biased upwardly by a compression spring 120 engaging the lower end 122 of the push rod 90. The push rod 90 has a rack segment 124 in mesh with a gear sector 126 of an annular cam follower 128. The cam follower 128 is mounted in a housing bore coaxial with the drive shaft 20 in a manner that permits limited axial and angular movement of the cam follower 128 and engages a fixed coaxial face cam 130 provided at the inner end of a non-rotatable pilot tube or bearing sleeve 132 which is rigidly mounted in said housing bore. The annular face cam 130 and cam follower 128 have three equiangularly spaced, cooperating cam ramps 133 to axially position the cam follower 128 in accordance with its angular position established by the linear push rod 90. In that manner, linear adjustment of the push rod 90 is translated into axial adjustment of the cam follower 128.

The cam follower 128 engages an annular thrust ring or collar 134 mounted on the drive shaft 20, and the collar 134 supports a transverse cross pin 135 that engages a linear push rod 136. The transverse cross pin 135 is mounted within a diametral slot 139 in drive shaft 20 to rotate with the shaft and to be axially shifted by the thrust ring 134. The linear push rod 136 is mounted within a central axial bore in the drive shaft 20 to engage the cross pin 135 at one end and the diametral rib 137 of the yoke 94 at the other end. A rectangular leaf spring 138 is mounted within the diametral slot 99 of the rotor to bias the yoke 94 axially against the push rod 136 and the cam follower 128 against the face cam 130.

Referring to FIG. 2, the control shaft 96 and input control cam 86 are shown in an idle position which is angularly displaced, for example 16 degrees in the clockwise directon as viewed in FIG. 2, from a start or cranking position of the control shaft 96. Upon rotation of the control shaft 96, in the counterclockwise direction as viewed in FIG. 2, to the start or cranking position, the step or arm 98 of the throttle cam 86 engages the adjustment screw 110 of the fuel control lever 88 to pivot the fuel control lever 88 and thereby shift the linear push rod 90 downwardly. The cam follower 128 is thereby rotated by the push rod 90 to axially withdraw the yoke 94 from the plungers 38 to establish a maximum plunger stroke limit position providing excess fuel for starting.

After starting, the fuel injection pump governor (either a min/max governor or a full speed range governor) provides for establishing a predetermined idle speed. When a min/max governor is used, as the control shaft 96 is rotated, in the clockwise direction as viewed in FIG. 2, to its idle speed position shown in FIG. 2, the control cam 101 engages the fuel control lever 88 (and the step 98 becomes disengaged from the adjustment screw 110) to establish a minimum plunger stroke limit position of the yoke 94. This minimum stroke is slightly greater than the maximum stroke required for proper idling. As the throttle shaft 96 is rotated further in the clockwise direction as viewed in FIG. 2, the cam 101 pivots the fuel control lever 88 about its a is to shift the linear push rod 90 downwardly to gradually withdraw the yoke 94 and thereby gradually increase the plunger stroke limit. The yoke 94 is thereby continuously axially positioned relative to the plungers 38 in accordance with the position of the control shaft 96. As previously indicated, when the stroke control mechanism is used with a full speed range governor, a cylindrical surface is preferably used in place of the cam 101 and such that the stroke limit is not changed by rotation of the control shaft 96 except to provide a longer stroke during starting. At all other conditions the member 86 limits the maximum stroke to a single fixed value corresponding to the maximum fuel delivery established for the engine.

When a min/max governor is used, as the throttle shaft 96 is advanced during engine operation, the metering valve 32 controls the output of the pump up to a predetermined throttle position. Thereafter, the output of the pump is regulated by the stroke control device, except that the min/max governor provides maximum speed governing in a conventional manner.

When a full speed range governor is used, the stroke control mechanism 84 provides an upper limit on the size or measure of the high pressure fuel charges delivered by the charge pump and the governor positions the metering valve 32 to control the fuel charges within that limit.

Figure 5:
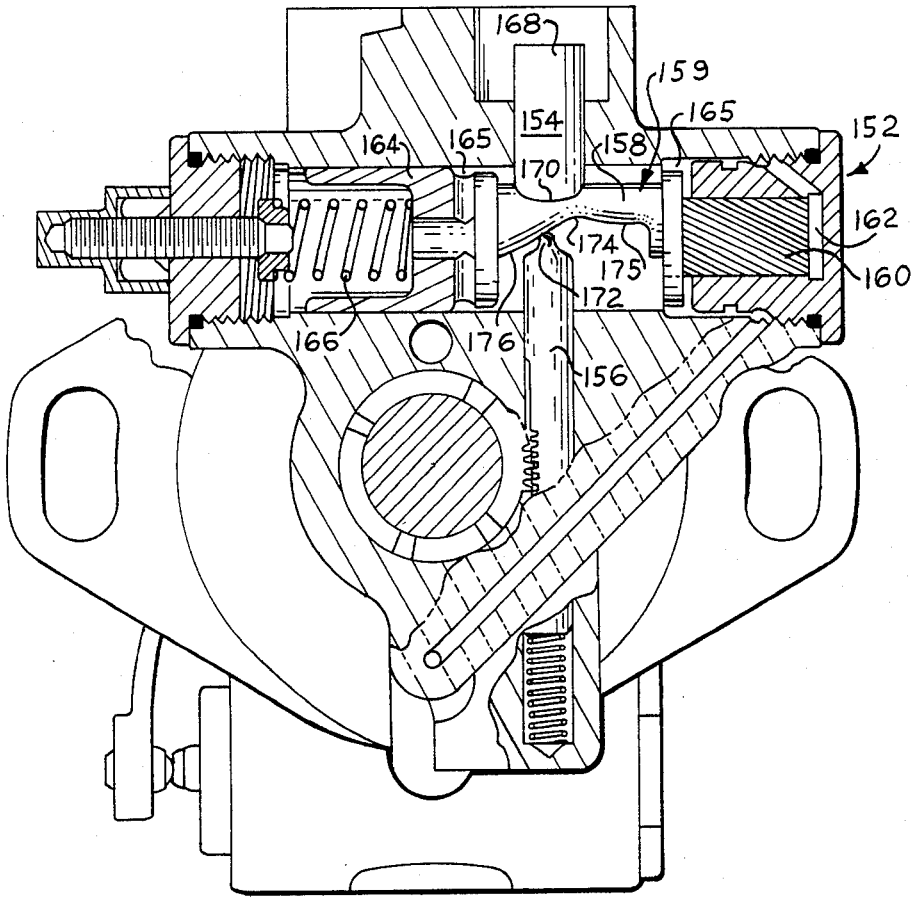
FIG. 5 is an enlarged partial transverse section view, partly broken away and partly in section, showing a modified embodiment of a plunger stroke control mechanism of the present invention.

A modified embodiment of the stroke control mechanism 84 is shown in FIG. 5 wherein the maximum stroke permitted by the axial position of the yoke 94 is also adjusted by a speed responsive control mechanism 152 which provides for a variable maximum stroke depending on speed. The additional speed responsive control is accomplished by varying the effective length of the push rod in accordance with the pump speed. For that purpose, a two part push rod 154 is used comprising upper and lower coaxial rod segments 168 and 156 interconnected by an intermediate shuttle or interponent 158 of a linear actuator 159 of the control mechanism 152.

The linear actuator 159 comprises a power piston 160 reciprocable within a bore 162 that is connected to receive transfer pump pressure to urge the linear actuator to the left as viewed in FIG. 5. A compression spring 166 engaging a piston 164 of the linear actuator 159 mounted in a bore 165 biases the linear actuator 159 to the right as viewed in FIG. 5 against the fuel transfer pressure at the outer end of the bore 162. Pistons 160 and 164 and the intermediate shuttle 158 therefore move axially as a unit and are positioned according to speed. Since the transfer pressure increases with pump speed, the linear actuator 159 is shifted gradually to the left as viewed in FIG. 5 as the engine speed increases.

The shuttle 158 is also mounted for linear displacement by the push rod 154 normal to the axis of the linear actuator 159 since the shuttle 158 is free to slide up and down between the abutting faces of the pistons 160 and 164. The upper end of the upper segment 168 of the push rod 154 engages the fuel control lever adjustment screw 116 while the lower end 170 of the upper segment 168 has a concave cylindrical end face or saddle which receives a conforming convex cylindrical surface of the shuttle 158 to prevent rotation of the shuttle 158. The upper end of the lower push rod segment 156 is formed to provide a cam follower 172 which engages a lower downwardly facing cam surface 174 of the shuttle 158. As seen in FIG. 5, the cam surface 174 of the shuttle extends transversely of the axis of the push rod 154.

In operation, the shuttle interponent 158 is shifted by the push rod 154 in response to movement of the fuel control lever 88 while the axial position of the shuttle interponent 158 relative to the push rod 154 is established by transfer pressure and therefore in accordance with engine speed.

The lower cam 174 of the shuttle 158 is designed to provide the desired speed responsive fuel curve shaping. In FIG. 5, the shuttle 158 is shown in the cranking speed position with the cam follower 172 engaging a ramp 176 of the cam 174 to increase the effective length of the adjustment rod 154 and thereby provide excess fuel for starting. In the modified embodiment shown in FIG. 5, the control cam arm 98 may or may not be used in conjuntion with the ramp 176 of cam 174 or it can be used without the ramp 176.

Once the engine starts, transfer pump pressure shifts the linear actuator 159 to the left as viewed in FIG. 5. The effective length of the push rod 154 reaches a minimum when the cam follower 172 engages the bottom of the ramp 176 at a preselected speed determined by the shuttle ramp geometry and the bias of the compression spring 166. An increase in speed from that preselected speed will increase the fuel delivery in accordance with a predetermined schedule established by a shuttle cam profile 175. Adjusting the fuel curve for particular applications can be achieved by varying the cam surface of the shuttle (i.e. using a different shuttle with a different cam shape) and/or using a spring 166 with different characteristics. Also, the spring bias can be adjusted with an adjustment screw to shift the speed responsive control as desired.

The modified embodiment shown in FIG. 5 can be further modified to provide a linear actuator 159 having the shuttle part 158 fixed to the end pistons 160, 164 and such that the yoke 94 is axially adjusted with the cam 174 solely in response to the fuel transfer pressure (or other variable pressure) at the outer end of the piston bore 162. With such an arrangement, the upper rod section 168, the fuel control lever 88 and its pivot shaft 104 and the input control cam 86 are not used and the fuel delivery is controlled by the metering valve 32 within a maximum limit established by the plunger stroke control mechanism. In addition, the cam 174 can then be modified to form a compound cam to control the yoke 94 by both axial and angular adjustment of the linear actuator 159. In that event, for example a suitable aneroid can be connected to angularly position the linear actuator 159. In turbocharged engine applications the linear actuator 159 can be similarly angularly positioned in accordance with the inlet manifold pressure.

Figure 7:
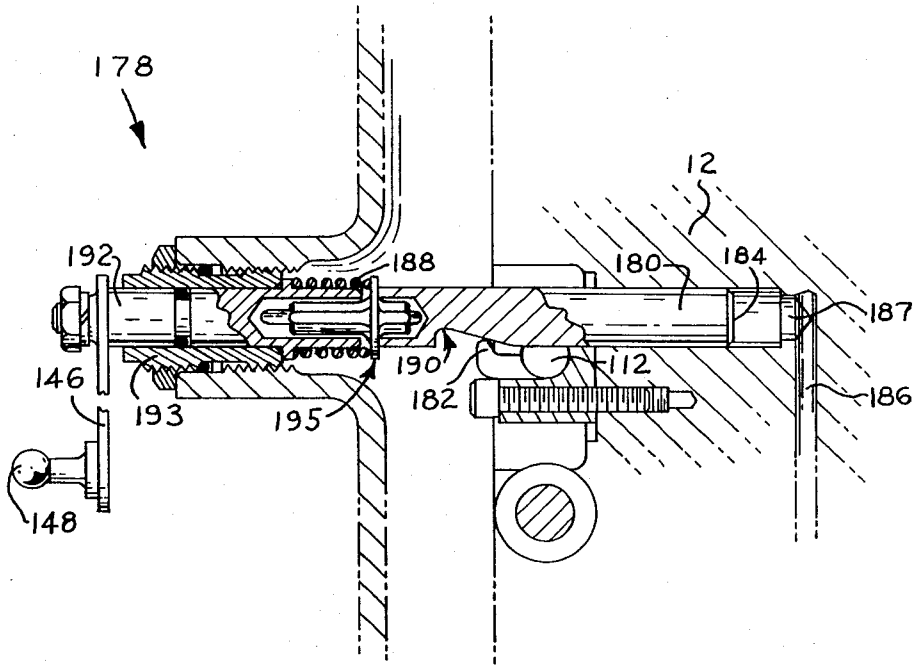
FIG. 7 is an enlarged partial side elevation section view, partly broken away and partly in section, of the fuel pump embodiment shown in FIG. 6.
Figure 6:
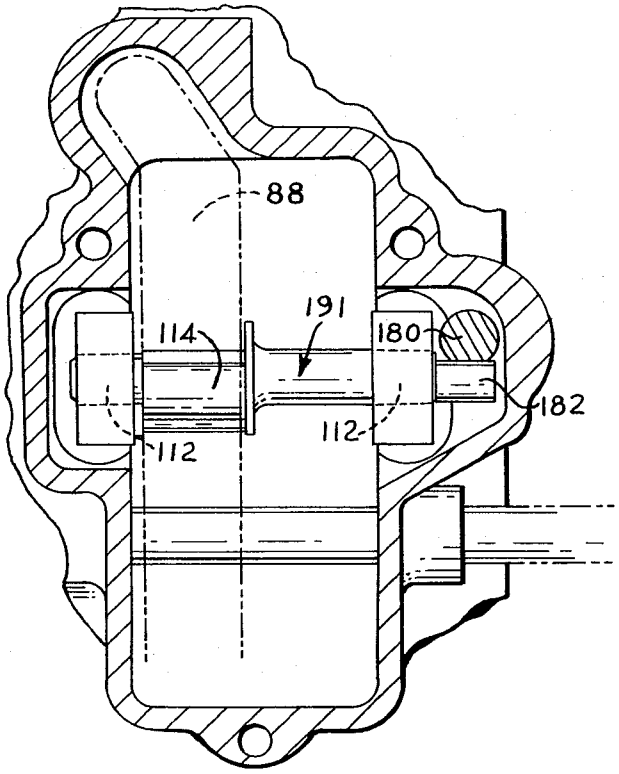
FIG. 6 is an enlarged partial top plan view, partly broken away and partly in section, showing another modified embodiment of a plunger stroke control mechanism of the present invention.

A further modified embodiment of the present invention shown in FIGS. 6 and 7 also provides both speed responsive maximum delivery control and altitude or boost compensation while retaining stroke control at part load operating conditions. In that embodiment, a compensation mechanism generally designated by the numeral 178 comprises an elongated linear piston 180 having a compound cam 190 that is engaged by a cam follower 182. The cam follower 182 is provided on an end of a fuel control lever pivot shaft 191 having an eccentric shaft segment 114 supporting the fuel control lever 88. Accordingly, the position of the pivot axis of the fuel control lever 88 is established by the angular and axial positions of the compound cam 190.

The piston 180 is mounted within a bore of the pump housing 12 for both angular and axial adjustment. Transfer pressure is supplied via passages 186 and 187 to the inner end of the piston bore to urge the piston 180 outwardly, to the left as viewed in FIG. 7, against the opposing bias of a compression spring 188. The bias of the compression spring 188 is adjustable by axial adjustment of an externally threaded shaft support bushing 193. The compound cam surface 190 extends both circumferentially and axially and is designed to shift the pivot axis 114 of the fuel control lever 88 to provide both speed responsive and altitude or boost responsive fuel curve shaping. Altitude/boost control is obtained by rotating the compound cam 180 via a crank arm 146 mounted on a control shaft 192 supported by the bushing 193. The control shaft 192 is rotatably mounted coaxial with the linear piston 180 and is coupled to the piston 180 by an elongated key or coupling part 195 having axially extending tangs or splines received within opposed axial slots in the shaft 192 and piston 180. A suitable altitude or inlet manifold pressure responsive sensor not shown) is connected to a ball 148 of the crank arm 146 to angularly position the cam 180.

Figure 8:
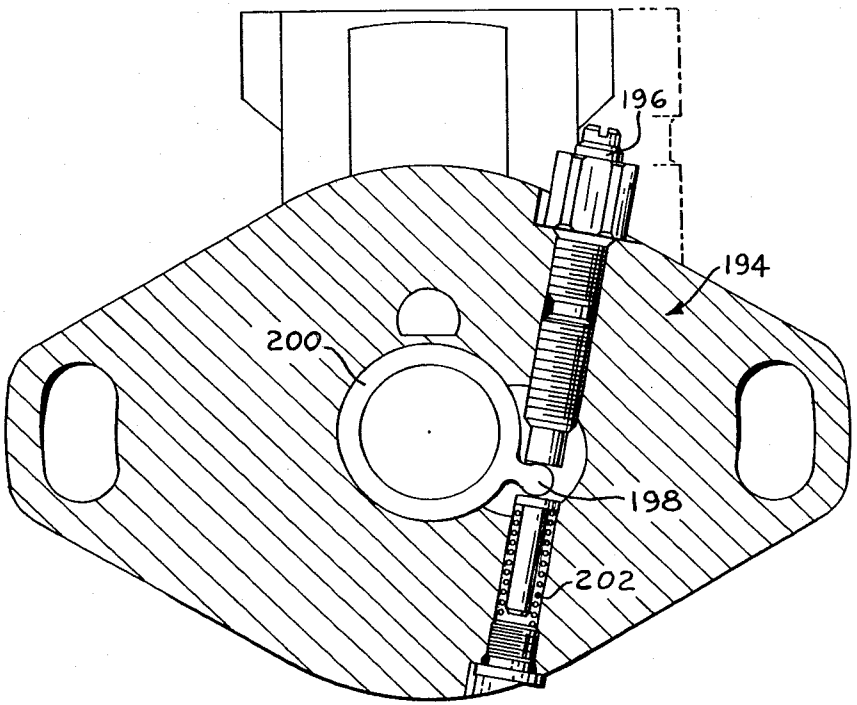
FIG. 8 is an enlarged transverse section view, partly in section, showing another modified embodiment of a plunger stroke control mechanism of the present invention.

Referring to FIGS. 8 and 12, a further modified embodiment of the present invention is shown which provides external control for establishing a fixed stroke limit of the pumping plungers 38. In this embodiment, the yoke 94 is axially positioned by an adjustment mechanism 194 which comprises a manual adjustment screw 196 mounted within a threaded bore of the pump housing. The adjustment screw 196 has an outer end slot for receiving a screwdriver and an outer lock nut for locking the screw 196 in its adjusted postion. An inner end of the adjustment screw 196 engages a radial lobe 198 of a cam follower 200 which controls the axial position of the yoke 94 in the same manner as the cam follower 128 previously described. A compression spring 202 is mounted within a housing bore to maintain the lobe 198 in engagement with the inner end of the adjustment screw 196. Thus, the adjustment screw 196 provides for setting the axial position of the yoke 94 to establish a fixed predetermined plunger stroke limit. Accordingly, this embodiment is designed to be used with the inlet metering valve 32 controlling the fuel injection charge up to the predetermined limit established by the yoke 94.

Referring to FIG. 14, a further modified embodiment 210 of the present invention is shown which provides two position stroke limit control of the pumping plungers 38. In this embodiment, the yoke 94 is selectively positioned at relatively short and long stroke limit positions depending on for example the fuel transfer pressure and therefore the pump speed. For that purpose, a piston 212 is reciprocably mounted within a central axial bore 214 in the pump drive shaft 20 to be actuated to the right as viewed in FIG. 14 by transfer pressure. The piston 212 has a forward projection 213 received within an axial bore in the shaft coupling tang 21 to engage and actuate the yoke 94 to its relatively short stroke position. The piston 212 is shifted in th opposite axial direction by the yoke return spring 138 to its relatively long stroke position shown in FIG. 14 established by a threaded stop 216. Fuel under transfer pressure is supplied to the inner end of the piston bore 214 via an axial bore in the stop 216, axial and radial bores 220, 222 in the drive shaft 20, an annulus 224 surrounding the shaft 20, a radial port 226 and axial slot 228 in the shaft mounting sleeve 132 and a suitable fuel passageway 230 in the pump housing.

The passageway 230 can be connected to receive fuel under transfer pressure directly from the transfer pump 22. At low cranking speeds, the biasing force of yoke return spring 138 is sufficient to hold the piston 212 against the stop 216 in opposition to transfer pressure to establish a relatively long plunger stroke for cranking. After the engine starts and the pump speed increases to a predetermined speed below idle speed, the transfer pressure shifts the piston 212 to the right as viewed in FIG. 14 into engagement with the tang 21 where it remains until the engine is shut down.

Alternately, as diagrammatically shown in FIG. 14, a control valve 232 can be provided to control the admission of fuel under transfer pressure to the inner end of the piston bore 214. With such an arrangement, the yoke 94 can be retained at either its relatively long or relatively short stroke position until the control valve 232 is shifted by transfer pressure to shift the yoke 94 to its other position. For example, the control valve 232 can be preset with a set screw 234 to initially connect the inner end of the piston bore 214 to exhaust (i.e. the housing cavity) as shown in FIG. 14 and then be actuated by transfer pressure to shift the piston 212 at some predetermined speed. In the alternative, the control valve 232 can be preset with the set screw 234 to initially connect the bore 214 to transfer pressure to maintain the yoke 94 at its relatively short stroke limit position until the control valve 232 is shifted by transfer pressure at a predetermined speed. Another alternative is to replace the control valve 232 with a solenoid valve or the like to operate in response to inlet manifold pressure or altitude. Thus, the two position stroke control device 210 can be used for example either to provide excess fuel for starting or to increase the plunger stroke limit above some predetermined speed or to provide off/on altitude or turbocharger compensation.

Figure 9:
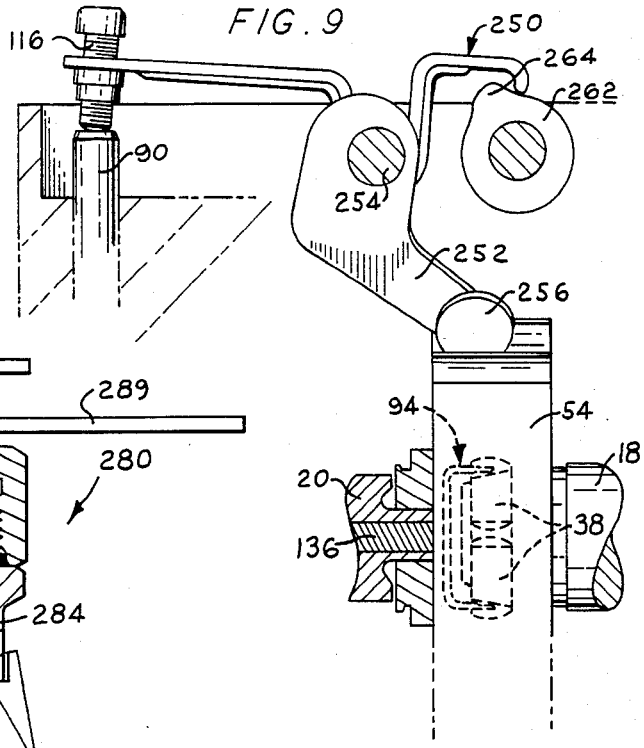
FIG. 9 is an enlarged partial side elevational section view, partly broken away and partly in section, showing another embodiment of the plunger stroke control mechanism of the present invention.
Figure 10:
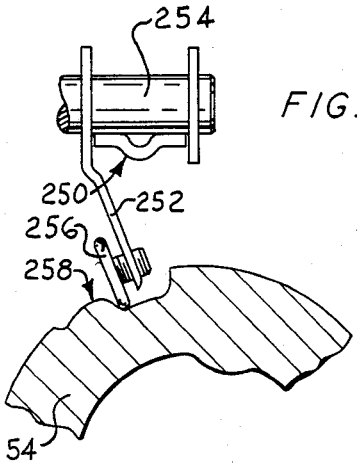
FIG. 10 is an enlarged partial transverse section view, partly broken away and partly in section, showing additional details of the plunger stroke control mechanism of FIG. 9.

A further modified embodiment of the present invention shown in FIGS. 9 and 10 provides a speed responsive control of the pivot axis of a fuel control lever 250 (which functions like the fuel control lever 88 previously described). A lever arm 252 is mounted on the fuel control lever pivot shaft 254 and a roller or follower 256 is mounted on the outer end of the arm 252 for engagement with circumerentially extending cam 258 provided on the cam ring 54. As previously described, the cam ring 54 is angularly adjusted to adjust the fuel injection timing according to speed and/or load. The circumferentially extending cam 258 thereby provides for adjusting the fuel control lever pivot axis in accordance with the pump speed and/or load. With this embodiment, the inlet metering valve 32 can be used to control the fuel injection charge only during low speed operation and maximum speed governing or in the alternative to completely control the fuel injection charge up to a load limit established by the yoke adjustment mechanism. In the former application, the fuel control cam provided on the throttle control shaft 96 would be like that described with reference to the embodiment shown in FIGS. 2 and 3. In the latter application, a different control cam 262 shown in FIG. 9 would be provided which has a single cam lobe 264 to provide excess fuel for starting and is otherwise circular.

Figure 15:
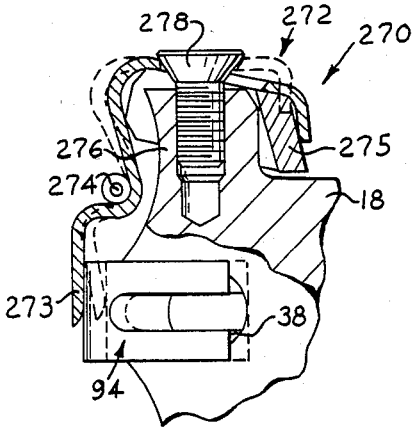
FIG. 15 is an enlarged partial longitudinal section view, partly broken away and partly in section, showing a still further embodiment of a plunger stroke control mechanism of the present invention.

Referring to FIG. 15, a further modified embodiment 270 of the present invention is shown which provides two position stroke limit control of the pumping plungers 38. In this embodiment, the yoke 94 is selectively positioned at relatively short and long stroke positions depending on the pivotal position of a weighted lever 272 mounted on the rotor 18. The lever 272 has an inner end 273 engaging the yoke 94 and is pivoted about an axis 274 normal to and radially offset from the axis of the rotor 18. A suitable weight 275 is mounted within an outer pocket of the lever 272 to urge the lever 272 in the counterclockwise direction as viewed in FIG. 15 against the opposing bias of the yoke return spring 138. The centrifugal force of the weight 275 and the bias of the yoke return spring 138 thereby establish the rotational speed at which the lever 272 shifts the yoke 94 from its relatively long stroke to its relatively short stroke position. The rotor 18 has a radial boss 276 and the weight 275 has a generally U-shape which partly encircles the boss 276 and the lever 272 engages the boss to establish the relatively long stroke position of the yoke 94. A threaded stop screw 278 is mounted within a threaded opening in the boss 276 and is adjusted to set the relatively short stroke position of the yoke 94. At low cranking speeds, the biasing force of the yoke return spring 138 is sufficient to hold the yoke 94 in its outer position to establish a larger fuel charge for cranking. After the engine starts and the pump speed increases to a predetermined speed below idle speed, the weighted lever 272 is pivoted counterclockwise as viewed in FIG. 1 by centrifugal force to shift the yoke 94 inwardly to where it remains until the engine is shut down.

Figure 16:
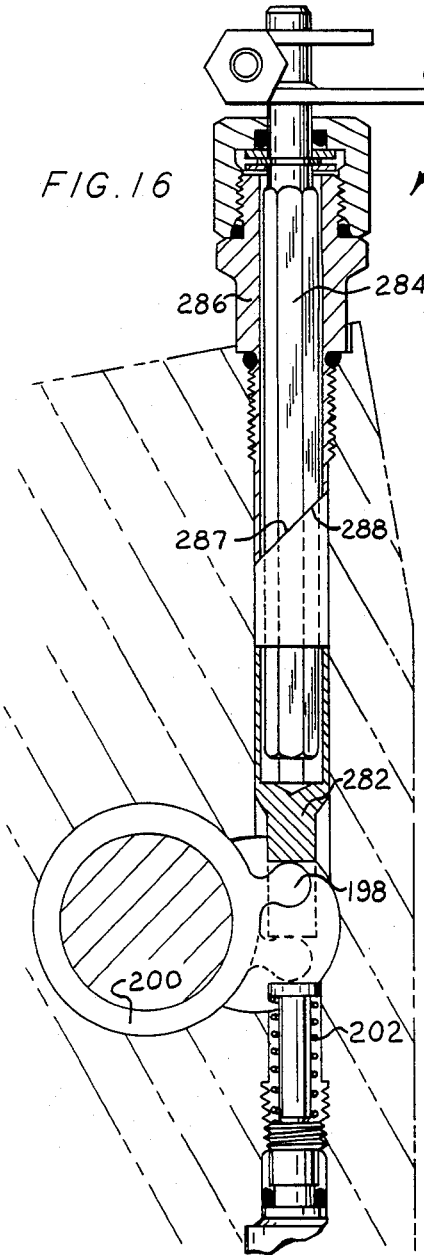
FIG. 16 is an enlarged partial transverse section view, partly broken away and partly in section, showing another embodiment of a plunger stroke control mechanism of the present invention.

Referring to FIG. 16, a further modified embodiment 280 of the present invention is shown which provides cam control of the axial position of the yoke 94. In this embodiment, the cam follower 200 (previously described with reference to the embodiment shown in FIG. 8) is angularly positioned by a control rod 282. The control rod 282 is angularly adjustable by a hexagonal operating shaft 284 which is received within a hexagonal bore in the control rod 282. The operating shaft 284 is also received within a cylindrical bore of a fixed cam sleeve 286 mounted within the pump housing. The control rod 282 and fixed cam sleeve 286 are coaxially mounted and have inclined engaging ends providing annular face cams 287, 288 to axially position the control rod 284 in accordance with its angular position. A lever arm 289 is adjustably mounted on the outer end of the operating shaft 284 to connect the operating shaft 284 for angular adjustment. For example, the lever arm 289 could be connected for speed control and/or altitude/boost compensation or merely be externally manually set to establish a fixed predetermined stroke limit.

Figure 11:
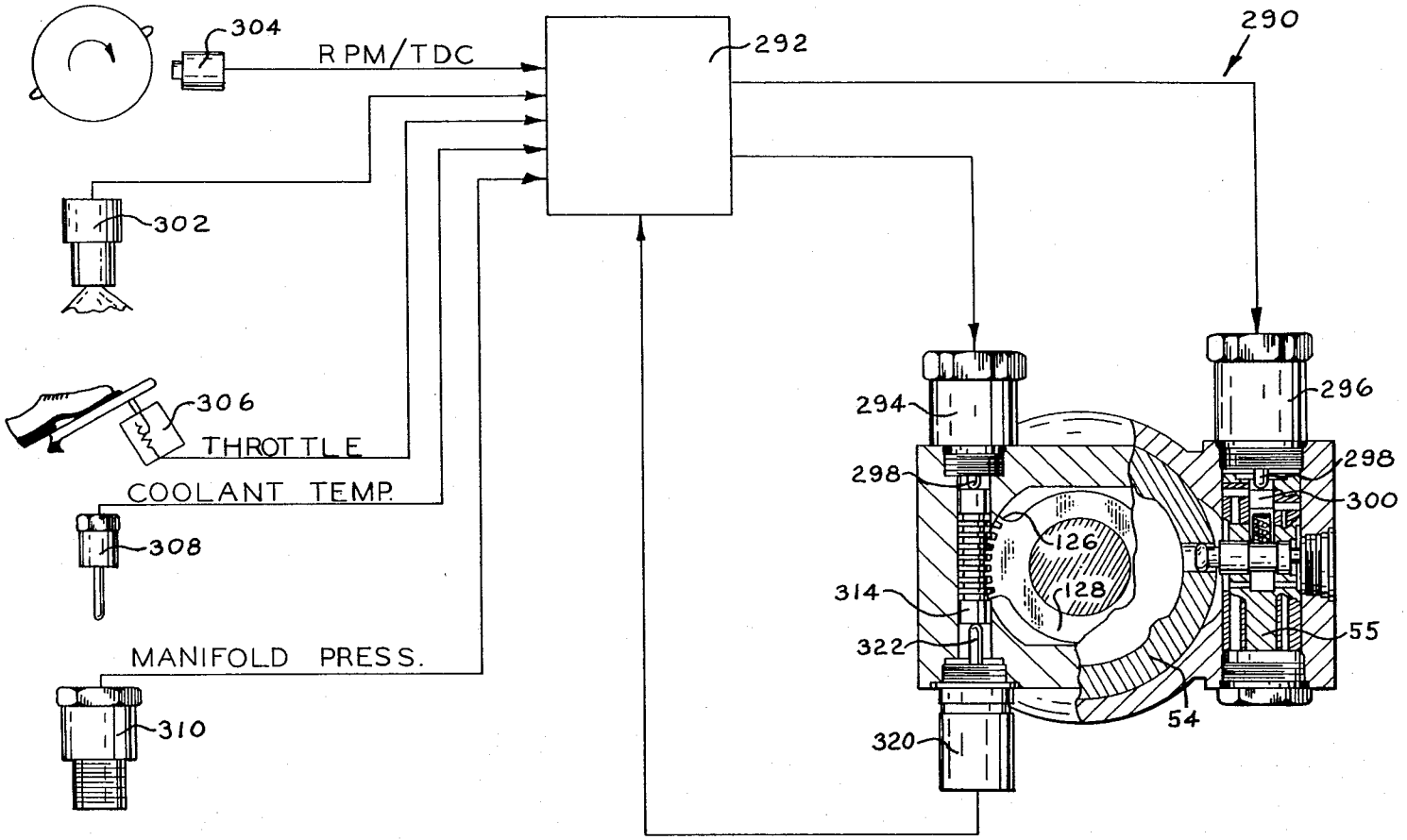
FIG. 11 is partly a diagrammatic illustration and partly a transverse section view showing another embodiment of a plunger stroke control mechanism of the present invention.
Figure 13:
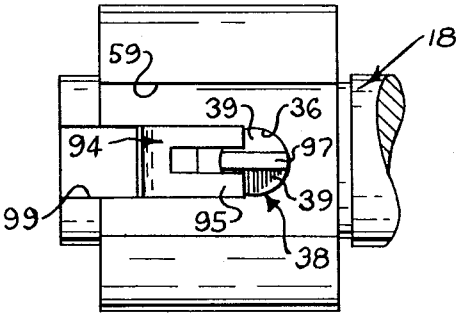
FIG. 13 is an enlarged partial longitudinal section view, partly broken away and partly in section, of the stroke limit device, taken generally along line 13—13 of FIG. 12.

Referring to FIG. 11, a further modified embodiment 290 of the present invention is shown which provides electronic control of the yoke 94. In this embodiment, a suitable microprocessor based electronic control unit 292 is employed for operating a bidirectional rotary stepping motor 294 for axially positioning the yoke 94 and also a second bidirectional rotary stepping motor 296 for controlling the fuel injection timing. Each stepping motor 294, 296 has a linear actuating pin 298 which is axially positioned by the respective stepping motor 294, 296. The linear pin 298 of the timing stepping motor 296 provides for positioning a hydraulic servo valve 300 which in turn provides for axially positioning the advance piston 55 in a known manner for establishing the fuel injection timing. A timing control loop is completed by fuel injection and top-dead-center (TDC) signals supplied to the electronic control unit 292. The fuel injection signal is provided by a suitable sensor 302 which senses fuel injection at one of the fuel injection nozzles. A separate sensor 304 is provided for sensing the TDC position preferably of the same nozzle for computing with the electronic control unit 292 the fuel injection timing relative to TDC. The latter signal is also employed for computing the engine RPM. The remaining sensors shown employed in the system are a throttle position sensor 306, an engine coolant temperature sensor 308 and a manifold pressure sensor 310. The signals generated by those sensors 306, 308 and 310 are, like the signals generated by sensors 302, 304, transmitted to the electronic control unit 292 which processes those signals to operate the timing stepping motor 296 and thereby control the fuel injection timing in accordance with a predetermined schedule stored in the unit 292.

The linear actuating pin 298 of the fuel quantity stepping motor 294 axially positions the yoke 94 via a linear push rod 314 which serves as a rack gear for positioning the gear sector 126 of a cam follower 128. The cam follower 128 in turn axially positions the yoke 94 as previously described. A fuel quantity feedback sensor 320 has a linear plunger 322 engaging the opposite end of the push rod 314 and has an internal spring (not shown) for biasing its plunger 322 outwardly and thereby maintain the push rod 314 in engagement with the fuel quantity stepping motor 298. The fuel quantity feedback sensor 320 supplies a signal to the electronic control unit 292 to complete a fuel quantity control loop. The electronic control unit 292 controls the fuel quantity stepping motor 294 to control the plunger stroke limit in accordance with a predetermined schedule stored within the electronic control unit. The schedule can provide for control of the fuel quantity throughout either all or part of the full range of operation of the fuel injection pump. If desired, a governor operated inlet metering valve 32 can be employed for backup governing at the minium and maximum engine speeds. Alternatively, the stored fuel quantity schedule could be employed for setting a maximum fuel quantity limit throughout the full range of operating conditions of the associated engine.

The several described embodiments of the stroke limit control mechanism of the present invention can be used with either a min/max governor or a full speed range governor as described. Also, it will be apparent that the different features illustrated in connection with the several embodiments of the invention disclosed herein may be utilized and incorporated in other embodiments as desired. As will be apparent to persons skilled in the art, various modifications, adaptions and variations of the foregoing specific disclosures can be made without departing from the teachings of the present invention.

What is claimed is

1. In a rotary fuel injection pump for an internal combustion engine having a housing, a rotor with a coaxial drive shaft rotatable in the housing, the rotor having a plurality of radially extending plunger bores and a plunger pump for each plunger bore having a pumping plunger reciprocably mounted in the bore to receive and then deliver a charge of fuel, a cam ring with a cam contour surrounding the rotor and engageable with the plunger pumps to translate the cam contour into reciprocable movement of the plungers, a plunger stroke limit mechanism for limiting the outward stroke of the plungers comprising an abutment member mounted for rotation with the rotor and for axial movement relative to the rotor and having an abutment for each plunger pump engageable by the respective pumping plunger for variably limiting the outward stroke of the plunger in accordance with the axial position of the abutment member and an adjustment mechanism for adjusting the axial position of the abutment member, the improvement wherein the rotor and abutment member have cooperating means permitting radial movement of the abutment member to automatically adjust to different radial displacement of the plungers within their bores.

2. A fuel injection pump according to claim 1 wherein the rotor has a diametral slot and wherein the abutment member has a diametral rib received within the diametral slot in the rotor to permit said radial movement of the abutment member.

3. In a rotary fuel injection pump for an internal combustion engine having a housing, a rotor with a coaxial drive shaft rotatable in the housing, the rotor having a plurality of radially extending plunger bores and a plunger pump for each plunger bore having a pumping plunger reciprocably mounted in the bore to receive and then deliver a charge of fuel, a cam ring with a cam contour surrounding the rotor and engageable with the plunger pumps to translate the cam contour into reciprocable movement of the plungers, a plunger stroke limit mechanism for limiting the outward stroke of the plungers comprising an abutment member mounted for rotation with the rotor and for axial movement relative to the rotor and having an abutment for each plunger pump engageable by the respective pumping plunger for variably limiting the outward stroke of the plunger in accordance with the axial position of the abutment member and an adjustment mechanism for adjusting the axial position of the abutment member, the improvement wherein the adjustment mechanism comprises an annular coupling connected to the abutment member and having annular cam and annular cam follower members coaxial with the rotor drive shaft and relatively angularly adjustable about the axis of the rotor drive shaft for translating such relative angular adjustment into axial adjustment of the abutment member, and coupling positioning means for relatively angularly positioning the annular coupling members to axially position the abutment member.

4. A fuel injection pump according to claim 3 wherein the adjustment mechanism comprises a thrust bearing mounted on the rotor drive shaft in engagement with one of said annular members to axially position said abutment member in conjunction with the relative angular position of the annular coupling members.

5. A fuel injection pump according to claim 3 wherein the coupling positioning means comprises a manual adjustment screw connected to one of said coupling members for relative angular adjustment of the coupling members with the adjustment screw.

6. A fuel injection pump according to claim 1, 2, 3, 4 or 5 wherein each plunger has an axially inclined ramp engageable with the respective abutment of the abutment member for limiting the outward stroke of the plunger in accordance with the axial position of said abutment member.

7. A fuel injection pump according to claim 2 wherein said adjustment mechanism comprises a diametrically extending leaf spring mounted within said diametral slot in the rotor and engageable with said diametral rib for biasing said abutment member in on axial direction.

8. A fuel injection pump according to claim 1 or 3 wherein the rotor comprises at least one diametral bore providing a pair of diametrically opposed plunger bores and a diametral slot angularly aligned therewith and closely axially spaced therefrom, wherein the abutment member comprises a generally U-shaped yoke having a central diametrically extending rib received and axially and radially shiftable within said diametral slot in the rotor and a pair of abutment arms at the outer ends thereof providing said abutments engageable by the pumping plungers reciprocably mounted in said pair of diametrically opposed plunger bores.

9. A fuel injection pump according to claim 3 wherein the coupling positioning means comprises cooperating coaxial sleeves relatively angularly adjustable to adjust the axial position of one of said sleeves, said one sleeve being connected to one of said coupling members to angularly adjust said one coupling member upon axial adjustment of said one sleeve, and means received within the coaxial sleeves for relative angular adjustment thereof.

10. A fuel injection pump according to claim 3 wherein the coupling positioning means comprises an electrical actuator connected to one of said coupling members for relative angular adjustment of the coupling members with the electrical actuator.

11. A fuel injection pump according to claim 10 wherein the electrical actuator is a bidirectional electrical stepper motor.

12. A fuel injection pump according to claim 10 or 11 further comprising sensor means for sensing predetermined operating conditions including pump speed, and processing means for operating the electrical actuator to control the outward stroke of the plungers in accordance with said predetermined operating conditions.

13. A fuel injection pump according to claim 1 wherein the rotor comprises at least one diametral bore providing a pair of diametrically opposed plunger bores and a diametral slot angularly aligned therewith and closely axially spaced therefrom, wherein the abutment member comprises a generally U-shaped yoke having a central diametrically extending rib received and axially and radially shiftable within said diametral slot in the rotor and a pair of abutment arms at the outer ends thereof providing said abutments engageable by the pumping plungers reciprocably mounted in said pair of diametrically opposed plunger bores and wherein the abutment member adjustment mechanism comprises a pivotal weighted member pivotally mounted on the rotor about an axis transverse to its axis of rotation and engageable with the yoke to axially position the yoke in accordance with the pivotal position of the weighted member, spring means biasing the yoke in one axial direction, and adjustable means for limiting the axial movement of the yoke.

14. In a rotary fuel injection pump for an internal combustion engine having a housing, a rotor with a coaxial drive shaft rotatable in the housing, the rotor having at least one diametral bore providing a pair of angularly spaced radially extending plunger bores and a plunger pump for each plunger bore having a pumping plunger reciprocably mounted in the bore to receive and then deliver a charge of fuel, an axially extending roller and an axially extending roller shoe engageable with the pumping plunger, a cam ring with a cam contour surrounding the rotor and engageable with the rollers of the plunger pumps to translate the cam contour into reciprocable movement of the plungers, a plunger stroke limit mechanism for limiting the outward stroke of the plungers comprising an abutment member mounted for rotation with the rotor and for axial movement relative to the rotor and having an abutment for each plunger pump engageable by the pumping plunger for variably limiting the outward stroke of the plunger in accordance with the axial position of the abutment member and a adjustment mechanism for adjusting the axial position of the abutment member, the improvement wherein the rotor comprises a diametral slot closely axially spaced from and angularly aligned with said diametral bore in the rotor for the plungers, wherein the abutment member comprises a generally U-shaped yoke having a central diametrically extending portion received and axially and radially shiftable within said diametral slot in the rotor and a pair of abutment arms at the outer ends thereof providing said abutments engageable by the pumping plungers to limit the outward stroke of the plungers in accordance with the axial position of the abutment member.

15. The fuel injection pump according to claim 14 wherein the adjustment mechanism comprises a leaf spring mounted within said diametral slot in the rotor between the central rib of the yoke and said diametral bore and in engagement with said central rib to bias the yoke in one axial direction.

16. A fuel injection pump according to claim 14 or 15 wherein the rotor drive shaft has an axial bore and wherein the adjustment mechanism comprises a linear push rod axially shiftable within said axial bore and connected for axially shifting the yoke.

17. A fuel injection pump according to claim 14 or 15 wherein the rotor drive shaft has an axial bore and wherein the adjustment mechanism comprises a fuel pressure operated actuating piston axially shiftable within said axial bore and connected for axially shifting the yoke.

18. A fuel injection pump according to claim 14 or 15 wherein the adjustment mechanism comprises a fuel pressure operated linear actuating piston.

19. A fuel injection pump according to claim 14 wherein each of said pumping plungers has an outer end with a central projection engageable with the respective roller shoe and a pair of axially tapering abutment ramps on opposite circumferential sides of the central projection and wherein each abutment arm is bifurcated with a pair of circumferentially spaced abutment portions straddling the central projection of the respective pumping plunger and engageable with the pair of abutment ramps thereof to limit the outward stroke of the plunger.

20. The fuel injection pump according to claim 14, 15 or 19 wherein the adjustment mechanism comprises a linear actuator with a cam with an axially extending cam profile, cam follower means engageable with the cam profile of the linear actuator to axially position the yoke in accordance with the linear position of the linear actuator and means for axially positioning the linear actuator.

* * * * *